US011523472B2

(12) United States Patent
Kang et al.

(10) Patent No.: US 11,523,472 B2
(45) Date of Patent: Dec. 6, 2022

(54) INDUCTION HEATING APPARATUS

(71) Applicants: LG ELECTRONICS INC., Seoul (KR); UNIST (ULSAN NATIONAL INSTITUTE OF SCIENCE AND TECHNOLOGY), Ulsan (KR)

(72) Inventors: Kyelyong Kang, Seoul (KR); Jee Hoon Jung, Ulsan (KR); Hee Jun Lee, Seoul (KR); Hwa Pyeong Park, Ulsan (KR); See Hoon Jung, Ulsan (KR)

(73) Assignees: LG ELECTRONICS INC., Seoul (KR); UNIST (Ulsan National Institute of Science and Technology), Ulsan (KR)

( * ) Notice: Subject to any disclaimer, the term of this patent is extended or adjusted under 35 U.S.C. 154(b) by 299 days.

(21) Appl. No.: 16/755,406

(22) PCT Filed: Oct. 5, 2018

(86) PCT No.: PCT/KR2018/011797
§ 371 (c)(1),
(2) Date: Apr. 10, 2020

(87) PCT Pub. No.: WO2019/074246
PCT Pub. Date: Apr. 18, 2019

(65) Prior Publication Data

US 2020/0323044 A1 Oct. 8, 2020

(30) Foreign Application Priority Data

Oct. 11, 2017 (KR) ..... 10-2017-0131690

(51) Int. Cl.
*H05B 6/06* (2006.01)
*H05B 6/04* (2006.01)

(52) U.S. Cl.
CPC ..... *H05B 6/062* (2013.01); *H05B 6/04* (2013.01); *H05B 2213/05* (2013.01)

(58) Field of Classification Search
CPC ..... H05B 6/04; H05B 2213/05; H05B 6/062
See application file for complete search history.

(56) References Cited

U.S. PATENT DOCUMENTS 9,694,649 B2 7/2017 Seiler et al.
2020/0084842 A1* 3/2020 Yoshino ..... H05B 6/1236

FOREIGN PATENT DOCUMENTS

DE 10-2012-206940 11/2012
EP 2 334 142 6/2011
(Continued)

OTHER PUBLICATIONS

European Search Report dated May 31, 2021 issued in Application No. 18867063.2.
(Continued)

*Primary Examiner* — Dana Ross
*Assistant Examiner* — Kuangyue Chen
(74) *Attorney, Agent, or Firm* — KED & Associates LLP

(57) ABSTRACT

The present invention relates to an induction heating apparatus. In order to cope with various types of containers without increasing an operating frequency of an induction heating apparatus, the present invention compares a resistance value of a container with a predetermined reference resistance value, and determines an operating mode of a switching device according to a result of the comparison. According to the present invention, it is possible to use various types of containers without increasing an operating frequency of an induction heating apparatus, by adjusting a resonance frequency of a working coil according to a resistance value of a container used in the induction heating apparatus.

20 Claims, 6 Drawing Sheets

(56) References Cited

FOREIGN PATENT DOCUMENTS

| | | | |
|---|---|---|---|
| EP | 2 437 573 | | 4/2012 |
| EP | 2 170 010 | | 3/2015 |
| JP | 2015-198060 | | 11/2015 |
| KR | 1999-0017237 | | 3/1999 |
| KR | 19990017237 A | * | 3/1999 |
| KR | 2003-0093404 | | 12/2003 |
| KR | 2009-0040679 | | 4/2009 |
| KR | 2013-0130036 | | 11/2013 |
| WO | WO 98/32310 | | 7/1998 |

OTHER PUBLICATIONS

International Search Report (with English Translation) and Written Opinion dated Jan. 25, 2019 issued in Application No. PCT/KR2018/011797.

* cited by examiner

INDUCTION HEATING APPARATUS

CROSS-REFERENCE TO RELATED PATENT APPLICATIONS

This application is a U.S. National Stage Application under 35 U.S.C. § 371 of PCT Application No. PCT/KR2018/011797, filed Oct. 5, 2018, which claims priority to Korean Patent Application No. 10-2017-0131690, filed Oct. 11, 2017, whose entire disclosures are hereby incorporated by reference.

1. TECHNICAL FIELD

The present disclosure relates to an induction heating apparatus.

2. BACKGROUND ART

Various types of cooking apparatuses are used to heat food at homes and restaurants. Conventionally, gas stoves that are fueled by gas have been widely used. However, in recent years, apparatuses for heating an object subject to heating such as a cooking container, e.g., a pot, which use electricity instead of gas, have been used.

Processes for heating an object using electricity are largely classified into resistance heating and induction heating. Electric resistance heating is a process in which an object subject to heating is heated by delivering heat, generated when electric current flows in a metallic resistance wire or a non-metallic heating element such as silicon carbide, to the object through radiation or conduction. Induction heating is a process in which an object itself subject to heating is heated by generating eddy currents in the object which consists of a metallic ingredient, using a magnetic field that is generated around a working coil when a predetermined magnitude of high-frequency electric power is supplied to the working coil.

The theory of induction heating is specifically described as follows. When an electric power source is supplied to an induction heating apparatus, a predetermined magnitude of high-frequency voltage is supplied to a coil. Accordingly, an induction magnetic field is generated around a working coil that is placed in the induction heating apparatus. When a magnetic line of force of the induction magnetic field that is generated as described above passes through the bottom of an object subject to heating, which includes a metallic ingredient and is placed on the induction heating apparatus, eddy currents are generated inside the bottom of the object. Then the generated eddy currents flow through the bottom of the object, and the object is heated.

When the induction heating apparatus is used, the upper plate of the induction heating apparatus is not heated while the object subject to heating is heated. Accordingly, when the object is lifted from the upper plate of the induction heating apparatus, the induction magnetic field around the coil vanishes, and the object stops generating heat immediately. Additionally, the working coil of the induction heating apparatus does not generate heat. Accordingly, temperature of the upper place of the induction heating apparatus remains low while food is cooking, thereby making it possible to ensure safety.

Further, the induction heating apparatus heats the object itself that is subject to heating through induction heating, thereby making it possible to ensure high energy efficiency, compared to a gas stove or a resistance heating apparatus. Furthermore, the induction heating apparatus can heat an object that is subject to heating for a shorter period of time than other types of heating apparatuses. When power output of the induction heating apparatus is higher, the induction heating apparatus can heat an object subject to heating more quickly.

In general, a conventional induction heating apparatus has an operating frequency of 70 kHz or less to reduce switching losses that are caused by electromagnetic interference (EMI) when the induction heating apparatus is driven and that are caused by switching operations of a switching device in the induction heating apparatus.

When the induction heating apparatus is used to heat a container that consists of a material such as aluminum with a relatively low resistance value, a relatively low voltage and a relatively large current are supplied to the working coil of the induction heating apparatus to generate electric power for heating. When a low voltage and a large current are supplied to the working coil of the induction heating apparatus, conduction loss occurs to the switching device, and an amount of heat generated by the working coil increases.

To solve the problem, when a container that consists of a material such as aluminum is used, an operating frequency may be increased to increase a resistance value of the container. However, the operating frequency of the induction heating apparatus is limitedly increased due to the switching losses of the switching devices.

DISCLOSURE

Technical Problem

The present disclosure provides an induction heating apparatus for which various types of containers may be used without increasing an operating frequency of the induction heating apparatus by adjusting a resonance frequency of a working coil based on a resistance value of the container which is used on the induction heating apparatus.

Objectives of the present disclosure are not limited to what has been described. Additionally, other objectives and advantages that have not been mentioned may be clearly understood from the following description and may be more clearly understood from embodiments. Further, it will be understood that the objectives and advantages of the present disclosure may be realized via means and a combination thereof that are described in the appended claims.

Technical Solution

As described above, the induction heating apparatus compares a resistance value of a container with a predetermined reference resistance value, and determines an operating mode of a switching device based on a result of the comparison, to be applied to various type of containers without increasing an operating frequency of the induction heating apparatus.

In the present disclosure, a switching device may operate in four modes and the like such as the triple frequency mode, the double frequency mode, the half-bridge mode, and the full-bridge mode.

In the triple frequency mode, a resonance frequency of a working coil of the induction heating apparatus is set to be three times as much as an operating frequency of the switching device. Additionally, in the double frequency mode, a resonance frequency of the working coil of the induction heating apparatus is set to be two times as much as an operating frequency of the switching device. A resonance frequency of the working coil is adjusted by adjusting capacitance of a variable capacitor unit that is included in an inverter unit.

Further, in the half-bridge mode and the full-bridge mode, a resonance frequency of the working coil is set to be the same as an operating frequency of the switching device. Magnitude of voltage that is delivered to the working coil, i.e., bridge voltage, when the induction heating apparatus operates in the half-bridge mode, is half the magnitude of bridge voltage when the induction heating apparatus operates in the full-bridge mode.

That is, according to the present disclosure, a resonance frequency of the working coil may be adjusted by adjusting capacitance of a variable capacitor unit that is included in an inverter unit, based on a resistance value of a container. Accordingly, the induction heating apparatus may be used for various types of containers with different resistance values without adjusting an operating frequency of the induction heating apparatus.

The induction heating apparatus according to an embodiment includes a rectifying unit that rectifies an AC voltage supplied by a power source and that outputs the rectified AC voltage, a smoothing unit that smooths the rectified AC voltage and that outputs a DC voltage, an inverter unit 108 that includes a first switching device, a second switching device, a third switching device, a fourth switching device, and a variable capacitor unit, that converts the DC voltage through switching operations and that outputs resonance current, a working coil that heats a container using the resonance current supplied by the inverter unit, and a control unit that compares a resistance value of the container with a predetermined reference resistance value, that determines an operating mode of the switching device based on results of the comparison, and that adjusts capacitance of the variable capacitor unit on the basis of the operating mode.

In an embodiment, the control unit may set the operating mode to a triple frequency mode when a resistance value of the container, which is measured in a state in which an operating frequency of a switching device included in the inverter unit is set to a predetermined first operating frequency, is less than a predetermined first reference resistance value. The control unit may adjust capacitance of the variable capacitor unit such that a resonance frequency of the working coil is three times as much as an operating frequency of the switching device.

Additionally, in an embodiment, the control unit may set the operating mode to a double frequency mode when a resistance value of the container, which is measured in a state in which an operating frequency of a switching device included in the inverter unit is set to a predetermined second operating frequency, is less than a predetermined second reference resistance value. The control unit may adjust capacitance of the variable capacitor unit such that a resonance frequency of the working coil is two times as much as an operating frequency of the switching device.

Further, in an embodiment, the control unit may set the operating mode to a half-bridge mode when a resistance value of the container, which is measured in a state in which an operating frequency of a switching device included in the inverter unit is set to a predetermined third operating frequency, is less than a predetermined third reference resistance value.

Further, in an embodiment, the control unit may set the operating mode to a full-bridge mode when a resistance value of the container, which is measured in a state in which an operating frequency of a switching device included in the inverter unit is set to a predetermined third operating frequency, is greater than or equal to a predetermined third reference resistance value.

Further, in an embodiment, the control unit may set the operating frequency to a predetermined restricted frequency when a resistance value of the container, which is measured in a state in which an operating frequency of a switching device included in the inverter unit is set to a predetermined third operating frequency, is greater than or equal to a predetermined fourth reference resistance value.

Furthermore, in an embodiment, the control unit may adjust capacitance of the variable capacitor unit such that a resonance frequency of the working coil is the same as an operating frequency of the switching device.

Advantageous Effects

An induction heating apparatus according to the present disclosure may be used for various types of containers without increasing an operating frequency of the induction heating apparatus by adjusting a resonance frequency of a working coil based on a resistance value of the containers used on the induction heating apparatus.

BEST MODE

Figure 1:
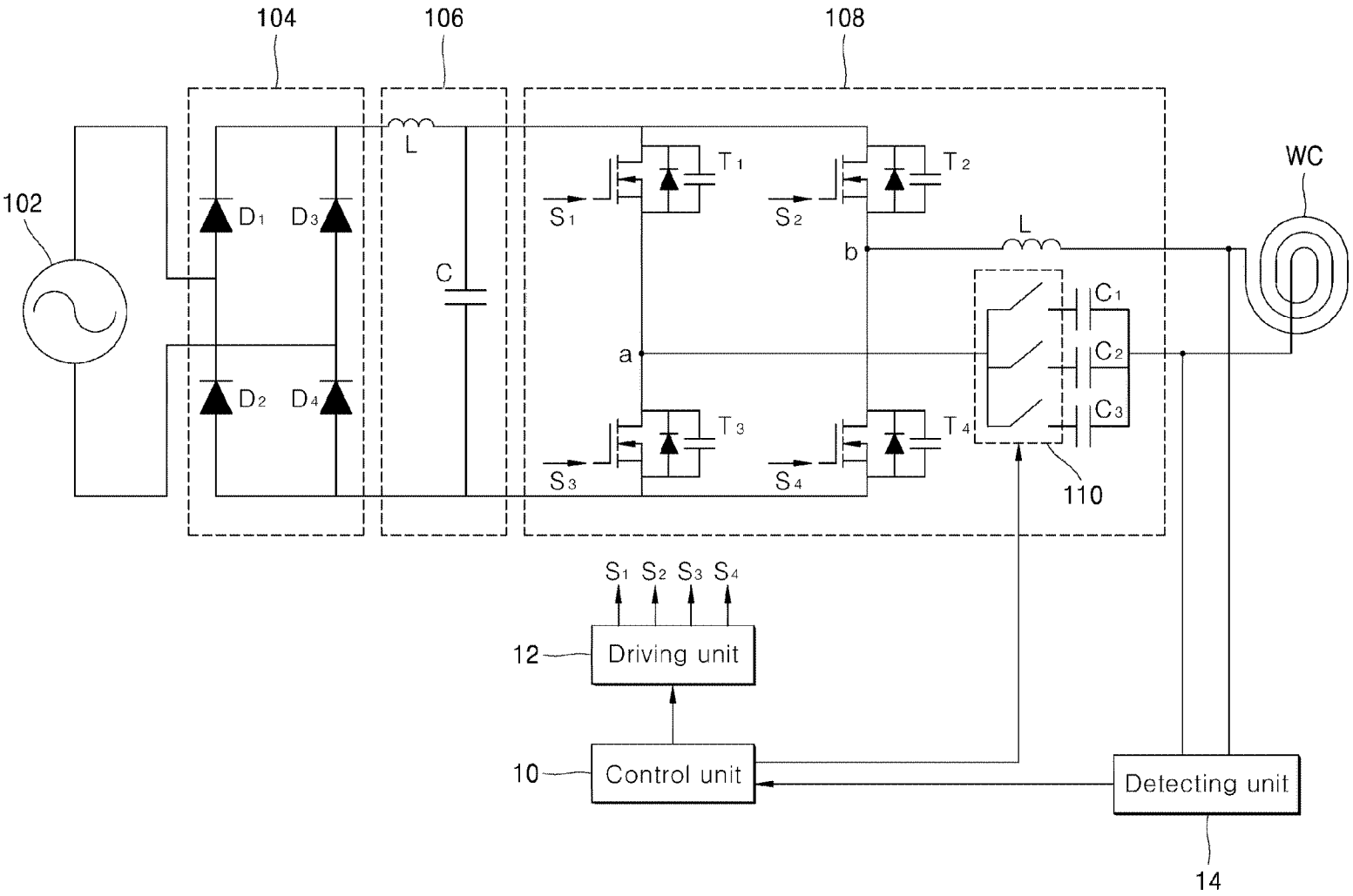
FIG. 1 is a block diagram illustrating an induction heating apparatus according to an embodiment of the present disclosure.

The above-described objectives, features and advantages are specifically described hereunder with reference to the attached drawings. Accordingly, one having ordinary skill in the art may readily implement the technical spirit of the present disclosure. Further, in describing the present disclosure, publicly-known technologies in relation to the disclosure are not specifically described if they are deemed to make the gist of the disclosure unnecessarily vague. Below, embodiments are specifically described with reference to the attached drawings. In the drawings, identical reference numerals denote identical or similar elements.

FIG. 1 is a block diagram illustrating an induction heating apparatus according to an embodiment of the present disclosure.

Referring to FIG. 1, an induction heating apparatus according to an embodiment of the present disclosure includes a rectifying unit 104, a smoothing unit 106, an inverter unit 108, and a working coil (WC). Additionally, the induction heating apparatus may further include a detecting unit 14.

The rectifying unit 104 rectifies AC input power that is supplied from a power source 102, and outputs a rectified power source voltage. The rectifying unit 104 may include a plurality of diodes. For instance, the rectifying unit 104 may consist of a first diode ($D_1$) and a second diode ($D_2$) that are connected in series with each other, and a third diode ($D_3$) and a fourth diode ($D_4$) that are connected in series with each other.

The smoothing unit 106 smooths the power source voltage that is rectified by the rectifying unit 104 and outputs a DC voltage. The smoothing unit 106 may consist of an inductor (L) and a capacitor (C) that are connected in series with each other.

The inverter unit 108 includes a plurality of switching devices. In an embodiment of the present disclosure, the inverter unit 108 includes four switching devices, i.e., a first switching device ($T_1$), a second switching device ($T_2$), a third switching device ($T_3$), and a fourth switching device ($T_4$).

The first switching device ($T_1$) and the second switching device ($T_2$) are connected in series with each other, and are complementarily turned on and turned off by switching signals ($S_1$, and $S_2$) that are supplied by a below-described driving unit 12. Likewise, the third switching device ($T_3$), and the fourth switching device ($T_4$) are connected in series with each other, and are complementarily turned on and turned off by switching signals ($S_3$, and $S_4$) that are supplied by the driving unit 12.

The complementary turn-on and turn-off of the switching devices are referred to as switching operations. The inverter unit 108 converts the DC voltage that is supplied by the smoothing unit 106 to output an AC voltage, through switching operations of the switching devices ($T_1$, $T_2$, $T_3$, and $T_4$).

Additionally, the inverter unit 108 includes an inductor ($L_r$) and a variable capacitor unit ($C_1$, $C_2$, and $C_3$) for converting the AC voltage that is output by switching operations of the switching devices into resonance current. The inductor ($L_r$) and variable capacitor unit ($C_1$, $C_2$, and $C_3$) are connected in series with the working coil (WC), and resonance current is supplied to the working coil (WC) through resonance by the AC voltage that is supplied by switching operations of the switching devices.

A relay unit 110 that includes relays for optionally connecting each capacitor with an output terminal (a) between the first switching device ($T_1$) and the second switching device ($T_2$) is connected to the variable capacitor unit ($C_1$, $C_2$, and $C_3$). As described below, the relays that are included in the relay unit 110 may be optionally opened or closed by a control unit 10. Capacitance of the variable capacitor unit ($C_1$, $C_2$, and $C_3$) may be determined on the basis of the number of the relays that are opened or closed by the control unit 10.

In the present disclosure, capacitance of the variable capacitor unit ($C_1$, $C_2$, and $C_3$) may be adjusted by adjusting the opening and closing of the relays included in the relay unit 110 by control of the control unit 10. As described above, resonance frequencies of resonance current that flows in the working coil (WC) may be adjusted by adjusting capacitance of the variable capacitor unit ($C_1$, $C_2$, and $C_3$).

FIG. 1 illustrates a variable capacitor unit that includes three capacitors ($C_1$, $C_2$, and $C_3$) for convenience of description. However, the number of the capacitors, and the capacitance of each of the capacitors that constitute the variable capacitor unit may vary depending on embodiments. Additionally, the number of the relays that constitute the relay unit 110 may vary based on the number of the capacitors that constitute the variable capacitor unit.

The working coil (WC) heats a container that is placed around the working coil (WC), using resonance current that is supplied from the inverter unit 108. When resonance current is supplied to the working coil (WC), eddy currents occur between the working coil (WC) and the container, a body of the container is heated, and contents in the container are heated.

The detecting unit 14 measures at least one of input current and input voltage that are supplied to the working coil (WC) and provides a result of the measurement to the control unit 10. The control unit 10 may calculate a resistance value of the container that is currently placed around the working coil (WC), using the result of the measurement that is delivered by the detecting unit 14.

The control unit 10 compares the resistance value of the container, which is calculated as described above, with a predetermined reference resistance value. The control unit 10 determines an operating mode of the switching devices ($T_1$, $T_2$, $T_3$, and $T_4$) that are included in the inverter unit 10, on the basis of results of comparison between the resistance value of the container and the reference resistance value. In the present disclosure, the switching devices ($T_1$, $T_2$, $T_3$, and $T_4$) may operate in any one of the triple frequency mode, the double frequency mode, the half-bridge mode, and the full-bridge mode.

Additionally, the control unit 10 may determine capacitance of the variable capacitor unit ($C_1$, $C_2$, and $C_3$) on the basis of the determined operating mode. The control unit 10 may control opening and closing of the relay unit 110 on the basis of the determined capacitance and may select a capacitor that will be connected between the output terminal (a) between the first switching device ($T_1$) and the second switching device ($T_2$), and the working coil (WC), among the capacitors ($C_1$, $C_2$, and $C_3$) that constitute the variable capacitor unit.

Further, the control unit 10 delivers a control signal to the driving unit 12 on the basis of the determined operating mode. The driving unit 12 generates switching signals ($S_1$, $S_2$, $S_3$, and $S_4$) that are supplied to the switching devices ($T_1$, $T_2$, $T_3$, and $T_4$), based on the control signal that is delivered by the control unit 10. Operating frequencies of the switching devices ($T_1$, $T_2$, $T_3$, and $T_4$) are determined according to waveforms of the switching signals ($S_1$, $S_2$, $S_3$, and $S_4$) that are generated by the driving unit 12.

Below, a process during which the control unit 10 determines operating modes of the switching devices ($T_1$, $T_2$, $T_3$, and $T_4$), and operation of the induction heating apparatus in each operating mode are described with reference to FIGS. 1 to 5.

When performance of a heating operation is asked by a user in a state in which a container is placed near the working coil (WC), the control unit 10 sets an operating frequency of the switching devices ($T_1$, $T_2$, $T_3$, and $T_4$) to a predetermined first operating frequency. In an embodiment, the first operating frequency may be set to be three times ($3 \times f_{min}$) as much as a minimum frequency ($f_{min}$). The minimum frequency ($f_{min}$) denotes a minimum value among operating frequencies that may drive the switching devices ($T_1$, $T_2$, $T_3$, and $T_4$) included in the induction heating apparatus.

The control unit 10 supplies switching signals to the switching devices ($T_1$, $T_2$, $T_3$, and $T_4$) through the driving unit 12 in a state in which the control unit 10 sets the operating frequency of the switching devices ($T_1$, $T_2$, $T_3$, and $T_4$) to the first operating frequency. When resonance current is supplied to the working coil (WC) through switching operations of the switching devices ($T_1$, $T_2$, $T_3$, and $T_4$), the control unit 10 calculates a resistance value of the container that is placed near the working coil (WC), using input voltage and input current that are detected by the detecting unit 14.

The control unit 10 compares the calculated resistance value of the container with a predetermined first reference resistance value. In an embodiment, the first reference resistance value ($R_{pot,t,max}$) may be set as in the following formula.

$$R_{pot,t,max} = \frac{G_{max} \cdot V_{in}^2}{4P_{rated}} \quad \text{Formula 1}$$

In [Formula 1], $G_{max}$ denotes a ratio of input voltage to output voltage of the inverter unit 108, i.e., a maximum voltage gain that is a maximum value among voltage gains, and $V_{in}$ denotes a voltage value that is supplied by a power source 102. Additionally, $P_{rated}$ denotes maximum rated power of the induction heating apparatus.

When the resistance value of the container is less than the first reference resistance value, as a result of comparison between the calculated resistance value of the container and the first reference resistance value, the control unit 10 sets an operating mode to a triple frequency mode.

Figure 2:
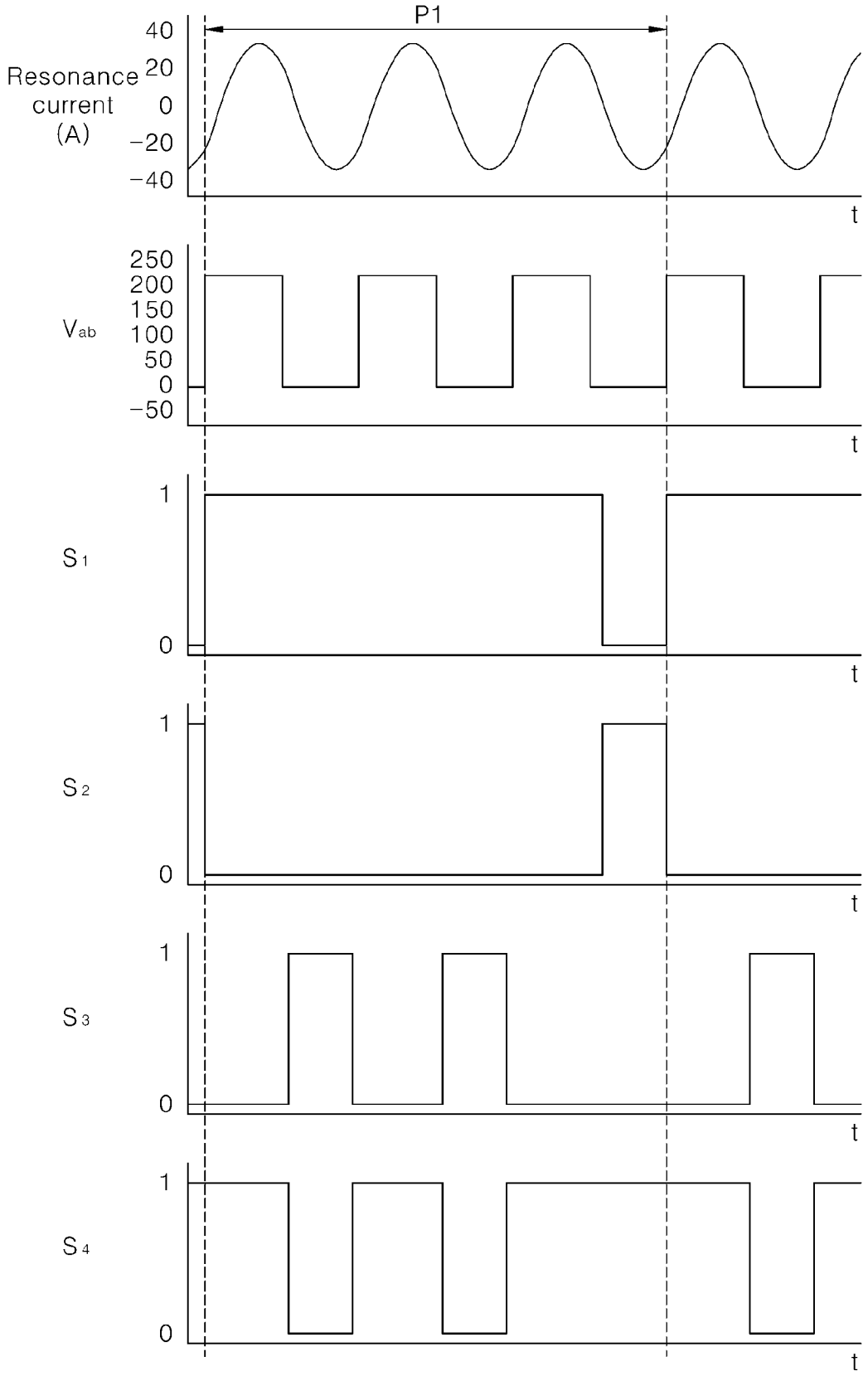
FIG. 2 is a view illustrating a waveform of resonance current of a working coil, a waveform of bridge voltage, and a waveform of a switching signal when a drive mode of a switching device of an induction heating apparatus according to an embodiment of the present disclosure is a triple frequency mode.

FIG. 2 illustrates a waveform of resonance current of the working coil, a waveform of bridge voltage ($V_{ab}$), and a waveform of the switching signal ($S_1$, $S_2$, $S_3$, and $S_4$) when a drive mode of the switching devices of the induction heating apparatus according to an embodiment is a triple frequency mode. The bridge voltage ($V_{ab}$) denotes a voltage value between the output terminal (a) and the output terminal (b), which is output by the switching operation of the switching devices ($T_1$, $T_2$, $T_3$, and $T_4$).

As described above, when the operating mode of the induction heating apparatus is determined as the triple frequency mode, the control unit 10 supplies a control signal to the driving unit 12 to output a switching signal ($S_1$, $S_2$, $S_3$, and $S_4$) of the waveform illustrated in FIG. 2.

Further, the control unit 10 sets capacitance ($C_{r.t}$) of a variable capacitor unit as in the following formula such that resonance current is output three times during one period (P1) of the switching signal ($S_1$, $S_2$, $S_3$, and $S_4$), in other words, such that a resonance frequency of the working coil (WC) in which resonance current flows is three times as much as an operating frequency of the switching devices ($T_1$, $T_2$, $T_3$, and $T_4$), as illustrated in FIG. 2.

$$C_{r.t} = \frac{1}{(2\pi f_{r.t})^2 L_r} \quad \text{Formula 2}$$

In [Formula 2], $f_{r.t}$ denotes a frequency that is three times as much as an operating frequency of the switching devices ($T_1$, $T_2$, $T_3$, and $T_4$), and $L_r$ denotes an inductance value of an inductor ($L_r$) illustrated in FIG. 1.

The control unit 10 controls the relay unit 110 such that capacitance of the variable capacitor unit ($C_1$, $C_2$, and $C_3$) is identical to the set capacitance ($C_{r.t}$) and selects a capacitor that will be connected. After setting the capacitance of the variable capacitor unit ($C_1$, $C_2$, and $C_3$), the control unit 10 generates the switching signals ($S_1$, $S_2$, $S_3$, and $S_4$) as in FIG. 2 through the driving unit 12 and drives the switching devices ($T_1$, $T_2$, $T_3$, and $T_4$), and accordingly, a heating operation is performed.

When the resistance value of the container is greater than or the same as the first reference resistance value, as a result of comparison between the calculated resistance value of the container and the first reference resistance value, the control unit 10 sets an operating frequency of the switching devices ($T_1$, $T_2$, $T_3$, and $T_4$) to a predetermined second operating frequency. In an embodiment, the second operating frequency may be set to be two times ($2 \times f_{min}$) as much as the minimum frequency ($f_{min}$).

The control unit 10 supplies switching signals to the switching devices ($T_1$, $T_2$, $T_3$, and $T_4$) through the driving unit 12 in a state in which the control unit 10 sets the operating frequency of the switching devices ($T_1$, $T_2$, $T_3$, and $T_4$) to the second operating frequency. When resonance current is supplied to the working coil (WC) through switching operations of the switching devices ($T_1$, $T_2$, $T_3$, and $T_4$), the control unit 10 calculates a resistance value of the container that is placed near the working coil (WC), using input voltage and input current that are detected by the detecting unit 14.

The control unit 10 compares the calculated resistance value of the container with a predetermined second reference resistance value. In an embodiment, the second reference resistance value ($R_{pot,d,max}$) may be set as in the following formula.

$$R_{pot,d,max} = \frac{G_{max} \cdot V_{in}^2}{4P_{rated}} \quad \text{Formula 3}$$

When the resistance value of the container is less than the second reference resistance value, as a result of comparison between the calculated resistance value of the container and the second reference resistance value, the control unit 10 sets an operating mode to a double frequency mode.

Figure 3:
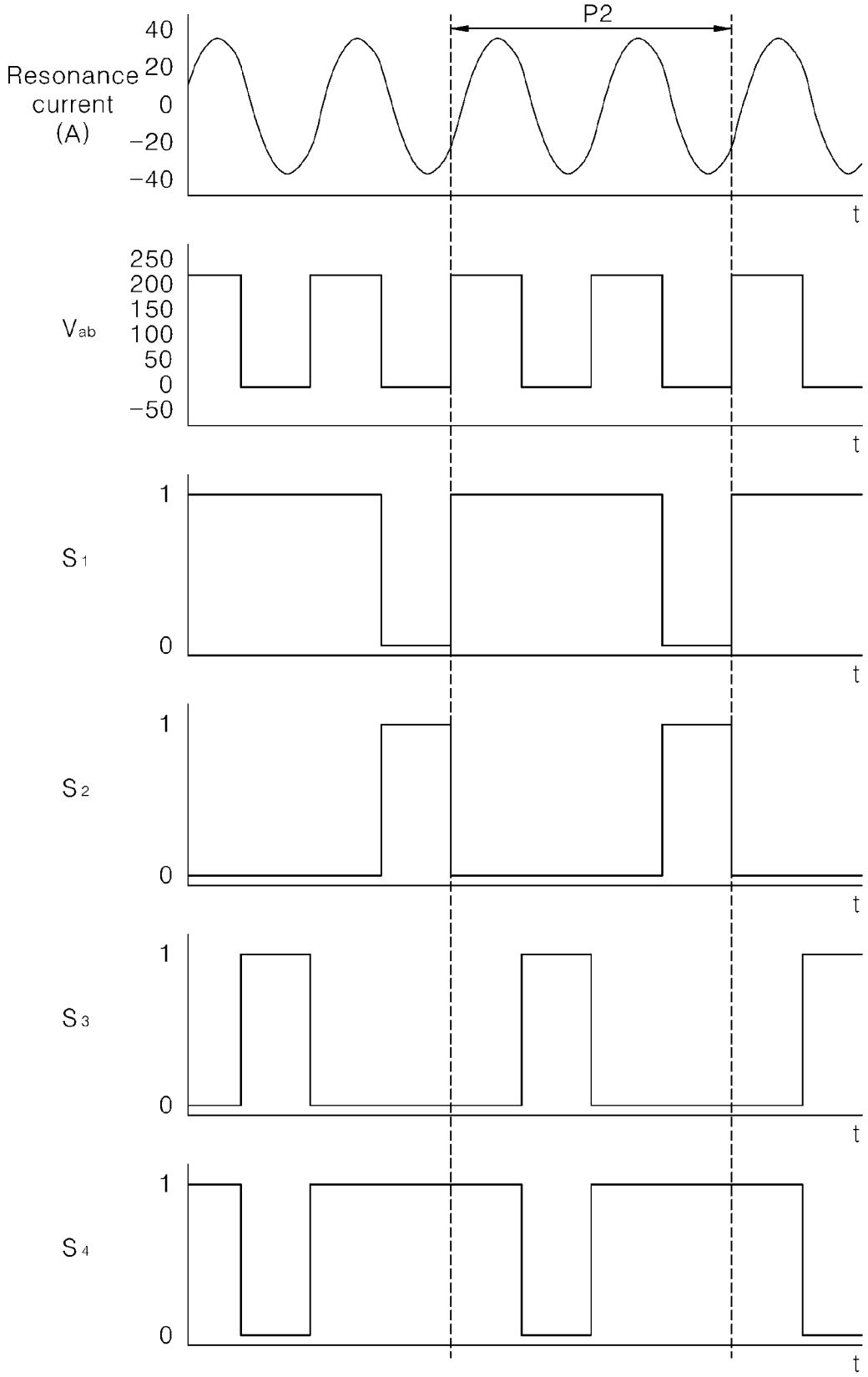
FIG. 3 is a view illustrating a waveform of resonance current of a working coil, a waveform of bridge voltage, and a waveform of a switching signal when a drive mode of a switching device of an induction heating apparatus according to an embodiment of the present disclosure is a double frequency mode.

FIG. 3 illustrates a waveform of resonance current of the working coil, a waveform of bridge voltage ($V_{ab}$), and a waveform of the switching signal ($S_1$, $S_2$, $S_3$, and $S_4$) when a drive mode of the switching devices of the induction heating apparatus according to an embodiment is a double frequency mode.

As described above, when the operating mode of the induction heating apparatus is determined as the double frequency mode, the control unit 10 supplies a control signal to the driving unit 12 to output a switching signal ($S_1$, $S_2$, $S_3$, and $S_4$) of the waveform illustrated in FIG. 3.

Further, the control unit 10 sets capacitance ($C_{r.d}$) of a variable capacitor unit as in the following formula such that resonance current is output two times during one period (P2) of the switching signal ($S_1$, $S_2$, $S_3$, and $S_4$), in other words, such that a resonance frequency of the working coil (WC) in which resonance current flows is two times as much as an operating frequency of the switching devices ($T_1$, $T_2$, $T_3$, and $T_4$), as illustrated in FIG. 3.

$$C_{r.d} = \frac{1}{(2\pi f_{r.d})^2 L_r} \quad \text{Formula 4}$$

In [Formula 4], $f_{r.d}$ denotes a frequency that is two times as much as an operating frequency of the switching devices ($T_1$, $T_2$, $T_3$, and $T_4$), The control unit 10 controls the relay unit 110 such that capacitance of the variable capacitor unit ($C_1$, $C_2$, and $C_3$) is identical to the set capacitance ($C_{r.d}$) and selects a capacitor that will be connected. After setting the capacitance of the variable capacitor unit ($C_1$, $C_2$, and $C_3$), the control unit 10 generates the switching signals ($S_1$, $S_2$, $S_3$, and $S_4$) as in FIG. 3 through the driving unit 12 and drives the switching devices ($T_1$, $T_2$, $T_3$, and $T_4$), and accordingly, a heating operation is performed.

When the resistance value of the container is greater than or the same as the second reference resistance value, as a result of comparison between the calculated resistance value of the container and the second reference resistance value, the control unit 10 sets an operating frequency of the switching devices ($T_1$, $T_2$, $T_3$, and $T_4$) to a predetermined third operating frequency. In an embodiment, the third operating frequency may be set to the minimum frequency ($f_{min}$).

The control unit 10 supplies switching signals to the switching devices ($T_1$, $T_2$, $T_3$, and $T_4$) through the driving unit 12 in a state in which the control unit 10 sets the operating frequency of the switching devices ($T_1$, $T_2$, $T_3$, and $T_4$) to the third operating frequency. When resonance current is supplied to the working coil (WC) through switching operations of the switching devices ($T_1$, $T_2$, $T_3$, and $T_4$), the control unit 10 calculates a resistance value of the container that is placed near the working coil (WC), using input voltage and input current that are detected by the detecting unit 14.

The control unit 10 compares the calculated resistance value of the container with a predetermined third reference resistance value. In an embodiment, the third reference resistance value ($R_{pot,h,max}$) may be set as in the following formula.

$$R_{pot,h,max} = \frac{G_{max} \cdot V_{in}^2}{4P_{rated}} \quad \text{Formula 5}$$

When the resistance value of the container is less than the third reference resistance value, as a result of comparison between the calculated resistance value of the container and the third reference resistance value, the control unit 10 sets an operating mode to a half-bridge mode.

Figure 4:
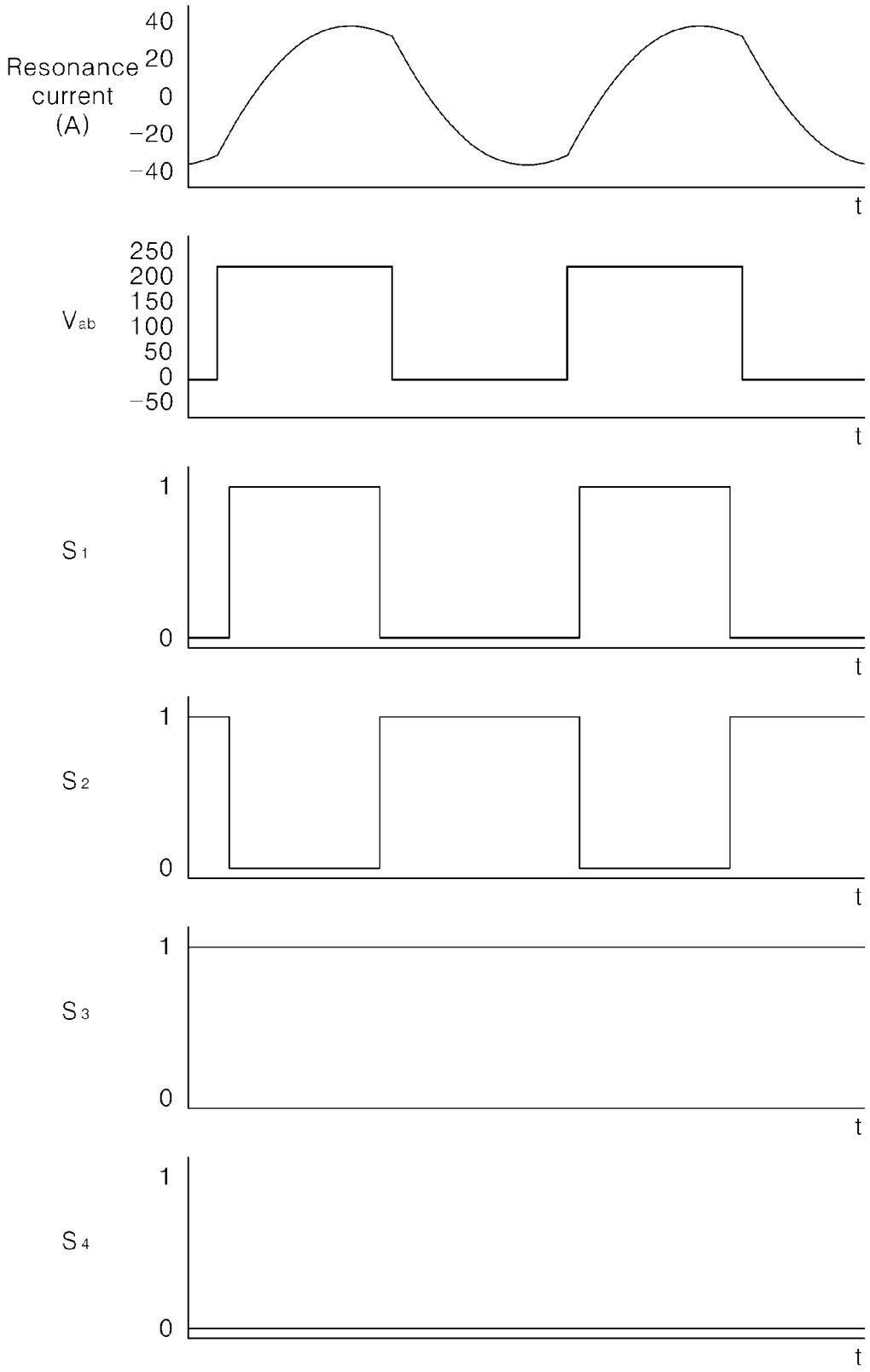
FIG. 4 is a view illustrating a waveform of resonance current of a working coil, a waveform of bridge voltage, and a waveform of a switching signal when a drive mode of a switching device of an induction heating apparatus according to an embodiment of the present disclosure is a half-bridge mode.

FIG. 4 illustrates a waveform of resonance current of the working coil, a waveform of bridge voltage ($V_{ab}$), and a waveform of the switching signal ($S_1$, $S_2$, $S_3$, and $S_4$) when a drive mode of the switching devices of the induction heating apparatus according to an embodiment is a half-bridge mode.

As described above, when the operating mode of the induction heating apparatus is determined as the half-bridge mode, the control unit 10 supplies a control signal to the driving unit 12 to output a switching signal ($S_1$, $S_2$, $S_3$, and $S_4$) of the waveform illustrated in FIG. 4.

Further, the control unit 10 sets capacitance ($C_{r.h}$) of a variable capacitor unit as in the following formula such that a resonance frequency of the working coil (WC) in which resonance current flows is the same as an operating frequency of the switching devices ($T_1$, $T_2$, $T_3$, and $T_4$), as illustrated in FIG. 4.

$$C_{r.h} = \frac{1}{(2\pi f_{r.h})^2 L_r} \quad \text{Formula 6}$$

In [Formula 6], $f_{r.h}$ denotes a frequency that is the same as an operating frequency of the switching devices ($T_1$, $T_2$, $T_3$, and $T_4$).

The control unit 10 controls the relay unit 110 such that capacitance of the variable capacitor unit ($C_1$, $C_2$, and $C_3$) is identical to the set capacitance ($C_{r.h}$) and selects a capacitor that will be connected. After setting the capacitance of the variable capacitor unit ($C_1$, $C_2$, and $C_3$), the control unit 10 generates the switching signals ($S_1$, $S_2$, $S_3$, and $S_4$) as in FIG. 4 through the driving unit 12 and drives the switching devices ($T_1$, $T_2$, $T_3$, and $T_4$), and accordingly, a heating operation is performed.

When the resistance value of the container is greater than or the same as the third reference resistance value, as a result of comparison between the calculated resistance value of the container and the third reference resistance value, the control unit 10 sets an operating mode to a full-bridge mode.

Then the control unit 10 compares the calculated resistance value of the container with a preset fourth reference resistance value. In an embodiment, the fourth reference resistance value ($R_{pot,f,max}$) may be set as in the following formula.

$$R_{pot,f,max} = \frac{G_{max} \cdot V_{in}^2}{P_{rated}} \quad \text{Formula 7}$$

When the resistance value of the container is less than the fourth reference resistance value, as a result of comparison between the calculated resistance value of the container and the fourth reference resistance value, the control unit 10 drives the induction heating apparatus in the full-bridge mode.

Figure 5:
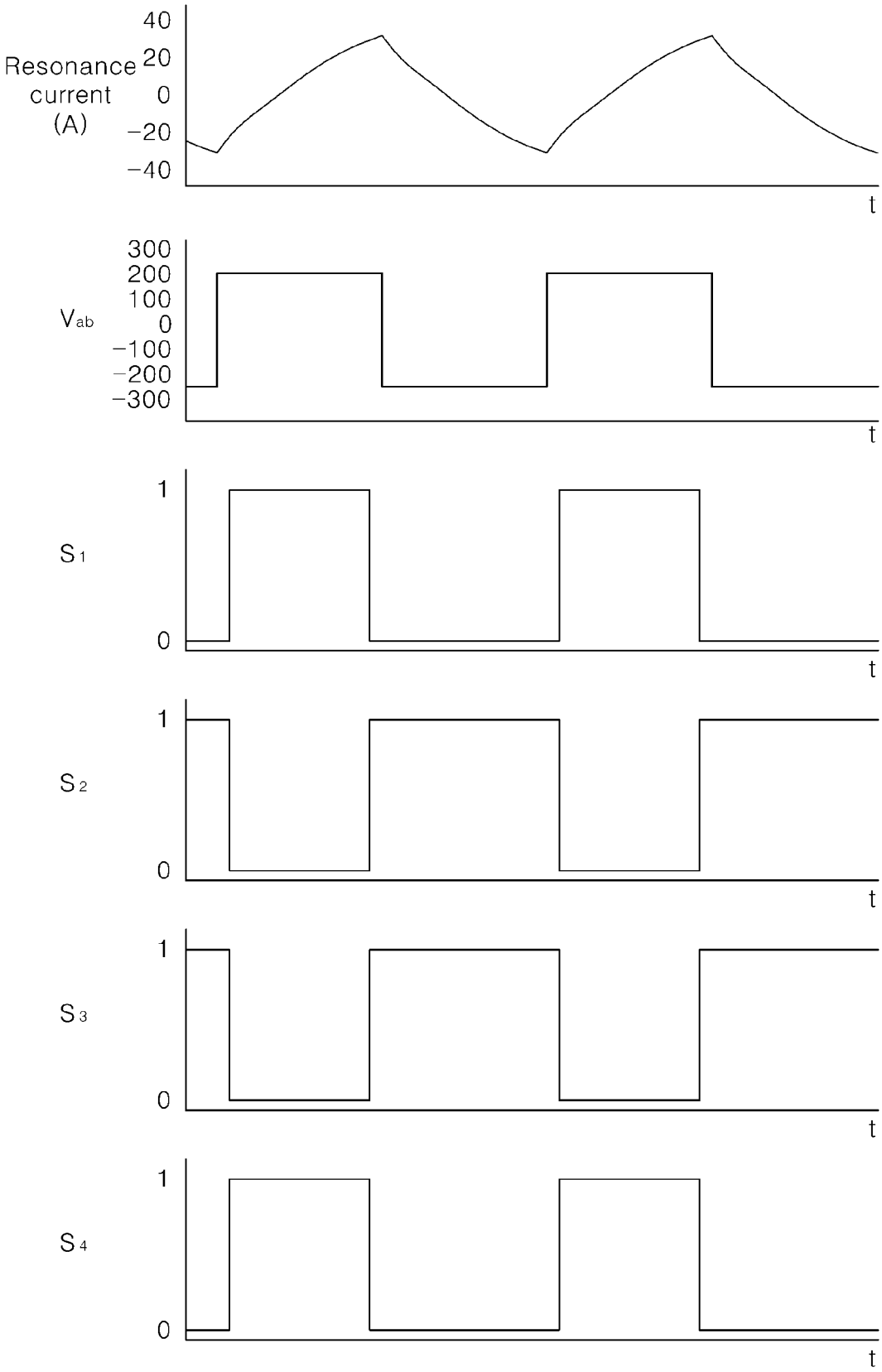
FIG. 5 is a view illustrating a waveform of resonance current of a working coil, a waveform of bridge voltage, and a waveform of a switching signal when a drive mode of a switching device of an induction heating apparatus according to an embodiment of the present disclosure is a full-bridge mode.

FIG. 5 illustrates a waveform of resonance current of the working coil, a waveform of bridge voltage ($V_{ab}$), and a waveform of the switching signal ($S_1$, $S_2$, $S_3$, and $S_4$) when a drive mode of the switching devices of the induction heating apparatus according to an embodiment is a full-bridge mode.

As described above, when the operating mode of the induction heating apparatus is determined as the full-bridge mode, the control unit 10 supplies a control signal to the driving unit 12 to output a switching signal ($S_1$, $S_2$, $S_3$, and $S_4$) of the waveform illustrated in FIG. 5.

Further, the control unit 10 sets capacitance ($C_{r.f}$) of a variable capacitor unit as in the following formula such that a resonance frequency of the working coil (WC) in which resonance current flows is identical to an operating frequency of the switching devices ($T_1$, $T_2$, $T_3$, and $T_4$), as illustrated in FIG. 5.

$$C_{r.f} = \frac{1}{(2\pi f_{r.f})^2 L_r} \quad \text{Formula 8}$$

In [Formula 8], $f_{r,f}$ denotes a frequency that is the same as an operating frequency of the switching devices ($T_1$, $T_2$, $T_3$, and $T_4$).

The control unit 10 controls the relay unit 110 such that capacitance of the variable capacitor unit ($C_1$, $C_2$, and $C_3$) is identical to the set capacitance ($C_{r,f}$), and selects a capacitor that will be connected. After setting the capacitance of the variable capacitor unit ($C_1$, $C_2$, and $C_3$), the control unit 10 generates the switching signals ($S_1$, $S_2$, $S_3$, and $S_4$) as in FIG. 5 through the driving unit 12 and drives the switching devices ($T_1$, $T_2$, $T_3$, and $T_4$), and accordingly, a heating operation is performed.

When the resistance value of the container is greater than or the same as the fourth reference resistance value, as a result of comparison between the calculated resistance value of the container and the fourth reference resistance value, the control unit 10 sets an operating frequency of the switching devices ($T_1$, $T_2$, $T_3$, and $T_4$) to a predetermined restricted frequency while setting an operating mode to the full-bridge mode. When the resistance value of the container is greater than or the same as the fourth reference resistance value, the induction heating apparatus may not operate at maximum power in the full-bridge mode. Accordingly, the control unit 10 limits an operating frequency of the switching devices ($T_1$, $T_2$, $T_3$, and $T_4$) to a restricted frequency, e.g., a resonance frequency of the working coil (WC).

Figure 6:
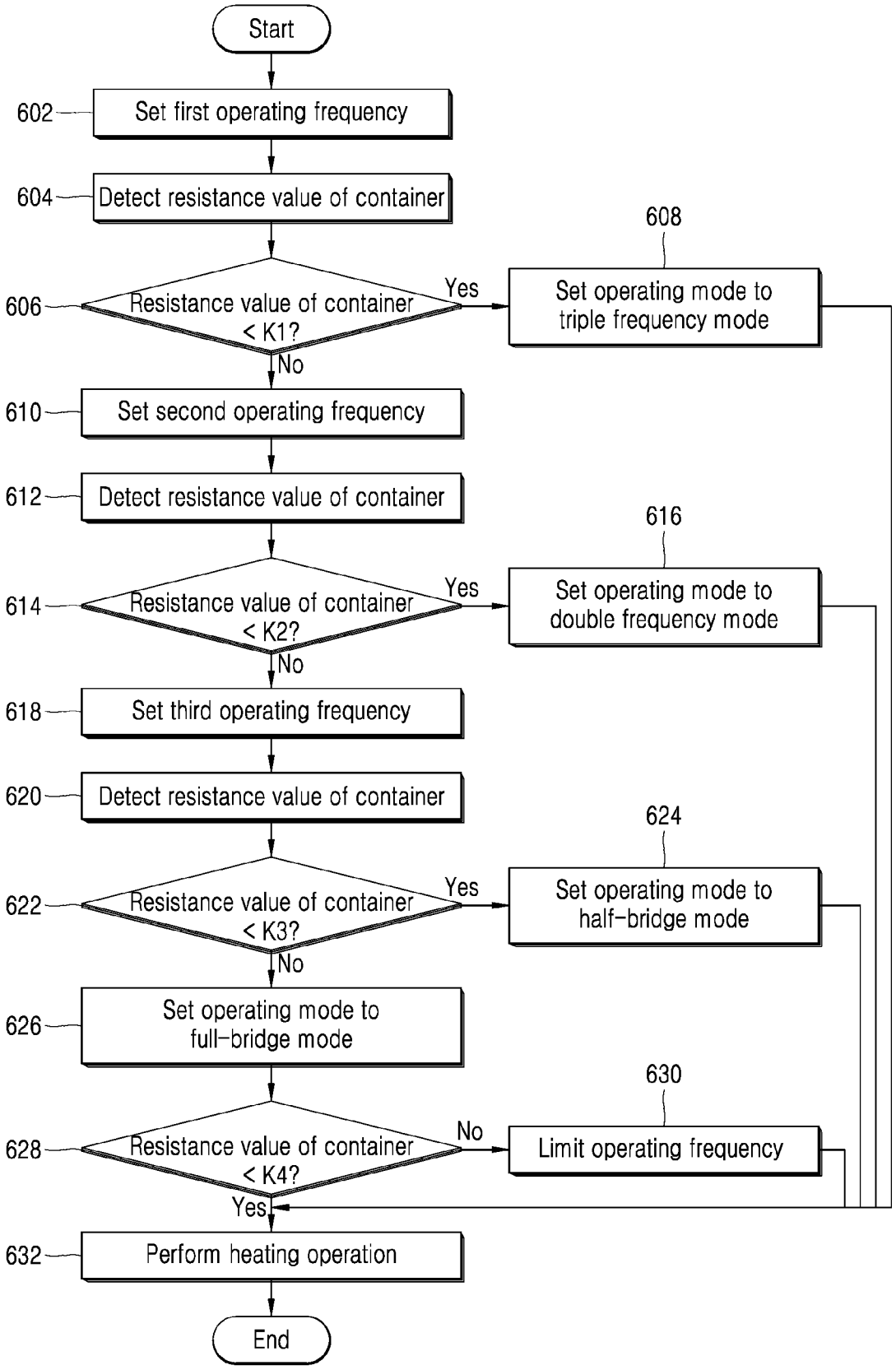
FIG. 6 is a flow chart illustrating a control method of an induction heating apparatus according to an embodiment of the present disclosure.

FIG. 6 is a flow chart illustrating a control method of an induction heating apparatus according to an embodiment of the present disclosure.

When performance of a heating operation is asked by a user in a state in which a container is placed near a working coil (WC), a control unit 10 sets an operating frequency of switching devices ($T_1$, $T_2$, $T_3$, and $T_4$) to a predetermined first operating frequency (602).

The control unit 10 supplies switching signals to the switching devices ($T_1$, $T_2$, $T_3$, and $T_4$) through a driving unit 12 in a state in which the control unit 10 sets the operating frequency of the switching devices ($T_1$, $T_2$, $T_3$, and $T_4$) to the first operating frequency. When resonance current is supplied to the working coil (WC) through switching operations of the switching devices ($T_1$, $T_2$, $T_3$, and $T_4$), the control unit 10 detects a resistance value of the container that is placed near the working coil (WC), using input voltage and input current that are detected by the detecting unit 14 (604).

Next, the control unit 10 compares the detected resistance value of the container with a predetermined first reference resistance value (K1) (606). When the resistance value of the container is less than the first reference resistance value (K1) as a result of the comparison (606), the control unit 10 sets an operating mode of the switching devices ($T_1$, $T_2$, $T_3$, and $T_4$) to a triple frequency mode (608).

Accordingly, the control unit 10 delivers control signals to the driving unit 12 to generate switching signals corresponding to the triple frequency mode, controls a relay unit 110 such that a resonance frequency of the working coil (WC) is three times as much as the operating frequency of the switching devices ($T_1$, $T_2$, $T_3$, and $T_4$), and adjusts capacitance of a variable capacitor unit ($C_1$, $C_2$, and $C_3$). After the triple frequency mode is set as described above, the control unit 10 supplies switching signals to the switching devices ($T_1$, $T_2$, $T_3$, and $T_4$) through the driving unit 12, and performs a heating operation (632).

When the resistance value of the container is greater than or the same as the first reference resistance value (K1) as a result of the comparison (606), the control unit 10 sets the operating frequency of the switching devices ($T_1$, $T_2$, $T_3$, and $T_4$) to a second operating frequency (610), and supplies switching signals to the switching devices ($T_1$, $T_2$, $T_3$, and $T_4$) through the driving unit 12. When resonance current is supplied to the working coil (WC) through switching operations of the switching devices ($T_1$, $T_2$, $T_3$, and $T_4$), the control unit 10 detects a resistance value of the container that is placed near the working coil (WC), using input voltage and input current that are detected by the detecting unit 14 (612).

Next, the control unit 10 compares the detected resistance value of the container with a predetermined second reference resistance value (K2) (614). When the resistance value of the container is less than the second reference resistance value (K2) as a result of the comparison (614), the control unit 10 sets the operating mode of the switching devices ($T_1$, $T_2$, $T_3$, and $T_4$) to a double frequency mode (616).

Accordingly, the control unit 10 delivers control signals to the driving unit 12 to generate switching signals corresponding to the double frequency mode, controls the relay unit 110 such that a resonance frequency of the working coil (WC) is two times as much as the operating frequency of the switching devices ($T_1$, $T_2$, $T_3$, and $T_4$), and adjusts capacitance of the variable capacitor unit ($C_1$, $C_2$, and $C_3$). After the double frequency mode is set as described above, the control unit 10 supplies switching signals to the switching devices ($T_1$, $T_2$, $T_3$, and $T_4$) through the driving unit 12, and performs a heating operation (632).

When the resistance value of the container is greater than or the same as the second reference resistance value (K2) as a result of the comparison (614), the control unit 10 sets the operating frequency of the switching devices ($T_1$, $T_2$, $T_3$, and $T_4$) to a third operating frequency (618), and supplies switching signals to the switching devices ($T_1$, $T_2$, $T_3$, and $T_4$) through the driving unit 12. When resonance current is supplied to the working coil (WC) through switching operations of the switching devices ($T_1$, $T_2$, $T_3$, and $T_4$), the control unit 10 detects a resistance value of the container that is placed near the working coil (WC), using input voltage and input current that are detected by the detecting unit 14 (620).

Next, the control unit 10 compares the detected resistance value of the container with a predetermined third reference resistance value (K3) (622). When the resistance value of the container is less than the third reference resistance value (K3) as a result of the comparison (622), the control unit 10 sets the operating mode of the switching devices ($T_1$, $T_2$, $T_3$, and $T_4$) to a half-bridge mode (624).

Accordingly, the control unit 10 delivers control signals to the driving unit 12 to generate switching signals corresponding to the half-bridge mode, controls the relay unit 110 such that a resonance frequency of the working coil (WC) is the same as the operating frequency of the switching devices ($T_1$, $T_2$, $T_3$, and $T_4$), and adjusts capacitance of the variable capacitor unit (Ci, $C_2$, and $C_3$). After the half-bridge mode is set as described above, the control unit 10 supplies switching signals to the switching devices ($T_1$, $T_2$, $T_3$, and $T_4$) through the driving unit 12, and performs a heating operation (632).

When the resistance value of the container is greater than or the same as the third reference resistance value (K3) as a result of the comparison (622), the control unit 10 sets the operating mode of the switching devices ($T_1$, $T_2$, $T_3$, and $T_4$) to a full-bridge mode (626). Then the control unit 10 compares the detected resistance value of the container with a predetermined fourth reference resistance value (K4) (628).

When the resistance value of the container is greater than or the same as the fourth reference resistance value (K4) as a result of the comparison (628), the control unit 10 sets the operating frequency of the switching devices ($T_1$, $T_2$, $T_3$, and $T_4$) to a predetermined restricted frequency, limits the operating frequency (630), and performs a heating operation (632).

When the resistance value of the container is less than the fourth reference resistance value (K4) as a result of the comparison (628), the control unit 10 supplies switching signals to the switching devices ($T_1$, $T_2$, $T_3$, and $T_4$) through the driving unit 12, and performs a heating operation (632).

The present disclosure that is described above may be replaced, changed and modified in different ways by one having ordinary skill in the art to which the disclosure pertains without departing from the technical spirit of the disclosure. Thus, the disclosure should not be construed as being limited to the embodiments and the attached drawings set forth herein.

The invention claimed is:

1. An induction heating apparatus, comprising:

a rectifying unit configured to rectify an AC voltage from a power source and to output the rectified AC voltage;

a smoothing unit configured to smooth a rectified AC voltage and to output a DC voltage;

an inverter unit including a plurality of switching devices, and a variable capacitor unit, and the inverter unit is configured to convert the DC voltage based on switching operations and to output a resonance current;

a working coil configured to heat a container, based on the resonance current from the inverter unit; and a controller configured to:

determine a resistance value of the container, compare the determined resistance value of the container with a predetermined reference resistance value, determine an operating mode of the plurality of switching devices based on a result of the comparing, and adjust capacitance of the variable capacitor unit to adjust a ratio of a resonance frequency of the working coil to an operating frequency of the plurality of switching devices based on the determined operating mode.

2. The induction heating apparatus of claim 1, wherein when the operating frequency of the plurality of switching devices is set to a predetermined first operating frequency, the controller is configured to set the operating mode of the plurality of switching devices to a triple frequency mode when the determined resistance value of the container is less than a predetermined first reference resistance value.

3. The induction heating apparatus of claim 2, wherein the controller is configured to adjust capacitance of the variable capacitor unit such that the resonance frequency of the working coil is three times as much as the operating frequency of the plurality of switching devices.

4. The induction heating apparatus of claim 2, wherein when the operating frequency of the plurality of switching devices is set to a predetermined second operating frequency, the controller is configured to set the operating mode of the plurality of switching devices to a double frequency mode when the determined resistance value of the container is less than a predetermined second reference resistance value.

5. The induction heating apparatus of claim 4, wherein the controller is configured to adjust capacitance of the variable capacitor unit such that the resonance frequency of the working coil is two times as much as the operating frequency of the plurality of switching devices.

6. The induction heating apparatus of claim 4, wherein when the operating frequency of the plurality of switching devices is set to a predetermined third operating frequency, the controller is configured to set the operating mode of the plurality of switching devices to a half-bridge mode when the determined resistance value of the container is less than a predetermined third reference resistance value.

7. The induction heating apparatus of claim 4, wherein when the operating frequency of the plurality of switching devices is set to a predetermined third operating frequency, the controller is configured to set the operating mode of the plurality of switching devices to a full-bridge mode when the determined resistance value of the container is greater than or equal to a predetermined third reference resistance value.

8. The induction heating apparatus of claim 7, wherein when the operating frequency of the plurality of switching devices is set to a predetermined fourth operating frequency, the controller is configured to set the operating frequency of the plurality of switching devices to a predetermined restricted frequency when the determined resistance value of the container is greater than or equal to a predetermined fourth reference resistance value.

9. The induction heating apparatus of claim 8, wherein the controller is configured to adjust capacitance of the variable capacitor unit such that *the resonance frequency of the working coil is the same as the operating frequency of the plurality of switching devices.

10. The induction heating apparatus of claim 7, wherein the controller is configured to adjust capacitance of the variable capacitor unit such that a resonance frequency of the working coil is the same as the operating frequency of the plurality of switching devices.

11. An induction heating apparatus, comprising:

a rectifying and smoothing device configured to rectify an AC voltage and to output a DC voltage;

an inverter device including a plurality of switching device and a variable capacitor device, and the inverter device is configured to receive the DC voltage and to output a resonance current;

a controller configured to:

determine a resistance value of an object on a coil, compare the determined resistance value with a predetermined resistance value, determine an operating mode of the plurality of switching devices based on the comparing of the determined resistance value and the predetermined resistance value, and change a ratio of a resonance frequency of the coil to an operating frequency of the plurality of switching devices by adjusting the variable capacitor device based on the determined operating mode.

12. The induction heating apparatus of claim 11, wherein while the operating frequency of the plurality of switching devices is a predetermined first operating frequency, the controller is configured to set the operating mode of the plurality of switching devices to a triple frequency mode when the determined resistance value of the object is less than a predetermined first resistance value.

13. The induction heating apparatus of claim 12, wherein the controller is configured to adjust capacitance of the variable capacitor device such that the resonance frequency of the coil is three times as much as the operating frequency of the plurality of switching devices.

14. The induction heating apparatus of claim 12, wherein while the operating frequency of the plurality of switching devices is a predetermined second operating frequency, the controller is configured to set the operating mode of the plurality of switching devices to a double frequency mode when the determined resistance value of the object is less than a predetermined second resistance value.

15. The induction heating apparatus of claim 14, wherein the controller is configured to adjust capacitance of the variable capacitor device such that the resonance frequency of the coil is two times as much as the operating frequency of the plurality of switching devices.

16. The induction heating apparatus of claim 14, wherein while the operating frequency of the plurality of switching devices is a predetermined third operating frequency, the controller is configured to set the operating mode of the plurality of switching devices to a half-bridge mode when the determined resistance value of the object is less than a predetermined third resistance value.

17. The induction heating apparatus of claim 14, wherein when the operating frequency of the plurality of switching devices is a predetermined third operating frequency, the controller is configured to set the operating mode of the plurality of switching devices to a full-bridge mode when the determined resistance value of the object is greater than or equal to a predetermined third resistance value.

18. The induction heating apparatus of claim 17, wherein while the operating frequency of the plurality of switching devices is a predetermined fourth operating frequency, the controller is configured to set the operating frequency of the plurality of switching devices to a predetermined restricted frequency when the determined resistance value of the object is greater than or equal to a predetermined fourth resistance value.

19. The induction heating apparatus of claim 18, wherein the controller is configured to adjust capacitance of the variable capacitor device such that the resonance frequency of the coil is the same as the operating frequency of the plurality of switching devices.

20. The induction heating apparatus of claim 17, wherein the controller is configured to adjust capacitance of the variable capacitor device such that the resonance frequency of the coil is the same as the operating frequency of the plurality of switching devices.

* * * * *